US005261233A

United States Patent [19]

Kishi

[11] Patent Number: 5,261,233

[45] Date of Patent: Nov. 16, 1993

[54] BRAKE DEVICE OF PNEUMATIC ROTATIONAL TOOL

[75] Inventor: Katsunobu Kishi, Tokyo, Japan

[73] Assignee: Nitto Kohki Co., Ltd., Tokyo, Japan

[21] Appl. No.: 871,049

[22] Filed: Apr. 20, 1992

[30] Foreign Application Priority Data

Apr. 23, 1991 [JP] Japan ..... 3-036483[U]
Jun. 12, 1991 [JP] Japan ..... 3-167562

[51] Int. Cl.[5] ..... F15B 11/08; F03B 13/04

[52] U.S. Cl. ..... 60/436; 415/123; 415/904; 173/93; 173/156

[58] Field of Search ..... 173/91, 93, 47, 156; 60/407, 436; 415/80, 82, 123, 904

[56] References Cited

U.S. PATENT DOCUMENTS

| | | | |
|---|---|---|---|
| 3,199,411 | 8/1965 | Gransten | 91/204 |
| 3,245,322 | 4/1966 | Gransten et al. | 91/204 |
| 3,502,984 | 9/1962 | Mitthauer et al. | 415/123 X |
| 3,712,386 | 1/1973 | Peters | 415/123 X |
| 3,945,757 | 3/1976 | Cummens | 415/123 X |
| 4,032,252 | 6/1977 | Ceresa | 415/25 |
| 4,087,198 | 5/1978 | Theis, Jr. | 415/904 X |
| 4,491,276 | 1/1985 | Reeves | 415/123 X |
| 4,494,933 | 1/1985 | Matsui | 415/904 X |
| 4,772,186 | 9/1988 | Pyles et al. | 415/904 X |
| 4,776,752 | 10/1988 | Davis | 415/82 X |

FOREIGN PATENT DOCUMENTS

| | | |
|---|---|---|
| 1062612 | 3/1967 | United Kingdom . |
| 1390979 | 4/1975 | United Kingdom . |
| 2249357A | 5/1992 | United Kingdom . |

*Primary Examiner*—Edward K. Look
*Assistant Examiner*—Hoang Nguyen
*Attorney, Agent, or Firm*—Nixon & Vanderhye

[57] ABSTRACT

In an open state of a valve, when a valve outside sleeve is rotated in the rear portion of a housing, a valve inner sleeve is moved forward to close a fluid channel, thus stopping supply of compressed driving air. Simultaneously, a front end of the valve outside sleeve is moved forward while it abuts against the rear surface of a retainer. Therefore, brake rods biased by compression coil springs are also moved forward, and front surfaces of the brake rods are abutted against a brake disk to effect braking, thereby immediately stopping rotation of a rotor. The urging force applied on the brake disk is the compression force of the compression coil springs.

5 Claims, 3 Drawing Sheets

BRAKE DEVICE OF PNEUMATIC ROTATIONAL TOOL

BACKGROUND OF THE INVENTION

1. Field of the Invention

The present invention relates to a brake device provided to an air motor of a pneumatic rotational tool.

2. Description of the Related Art

A pneumatic rotational tool, e.g., a grinder or a driller, is used for grinding and drilling various types of materials. In a pneumatic rotational tool of this type, two ends of a rotary shaft of a lightweight motor, e.g., an air turbine driven by compressed air are rotatably supported by bearings, and supply and the prevention of the supply of the compressed air to and from the turbine, respectively, are accomplished by an appropriate valve means.

According to the lightweight air motor of this type, the motor is not stopped immediately after supply of air is stopped by the valve means, unlike in a vane-type air motor, but continues to rotate for a long period of time because of the inertia of a rotating member depending on the types and characteristics of the rotational tool.

However, if rotation of the pneumatic rotational tool continues for some time even after the valve means is closed, problems arise in terms of safety. In addition, since the following operation or process cannot be smoothly started, the workability is poor.

SUMMARY OF THE INVENTION

It is an object of the present invention to provide a brake device suitable for a pneumatic rotational tool in which the problems of the pneumatic rotational tool described above are solved.

In order to achieve the above object, according to the present invention, in a brake device of a pneumatic rotational tool which supplies and stops supplying compressed air to an air motor by an opening/closing operation of a valve, brake rods interlocked with the opening/closing operation of the valve are provided to oppose the air motor.

When the valve is closed to stop supply of compressed air to the air motor, the brake rods interlocked with the opening/closing operation of the valve are moved close to the air motor, and the distal end surfaces of the brake rods are abutted against the periphery of the air motor, thereby immediately stopping rotation of the air motor.

On the other hand, when the valve is opened to supply compressed air to the air motor, the brake rods, interlocked with this valve operation, are separated from the air enabling rotation of the motor.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DETAILED DESCRIPTION OF THE PREFERRED EMBODIMENT

Figure 1:
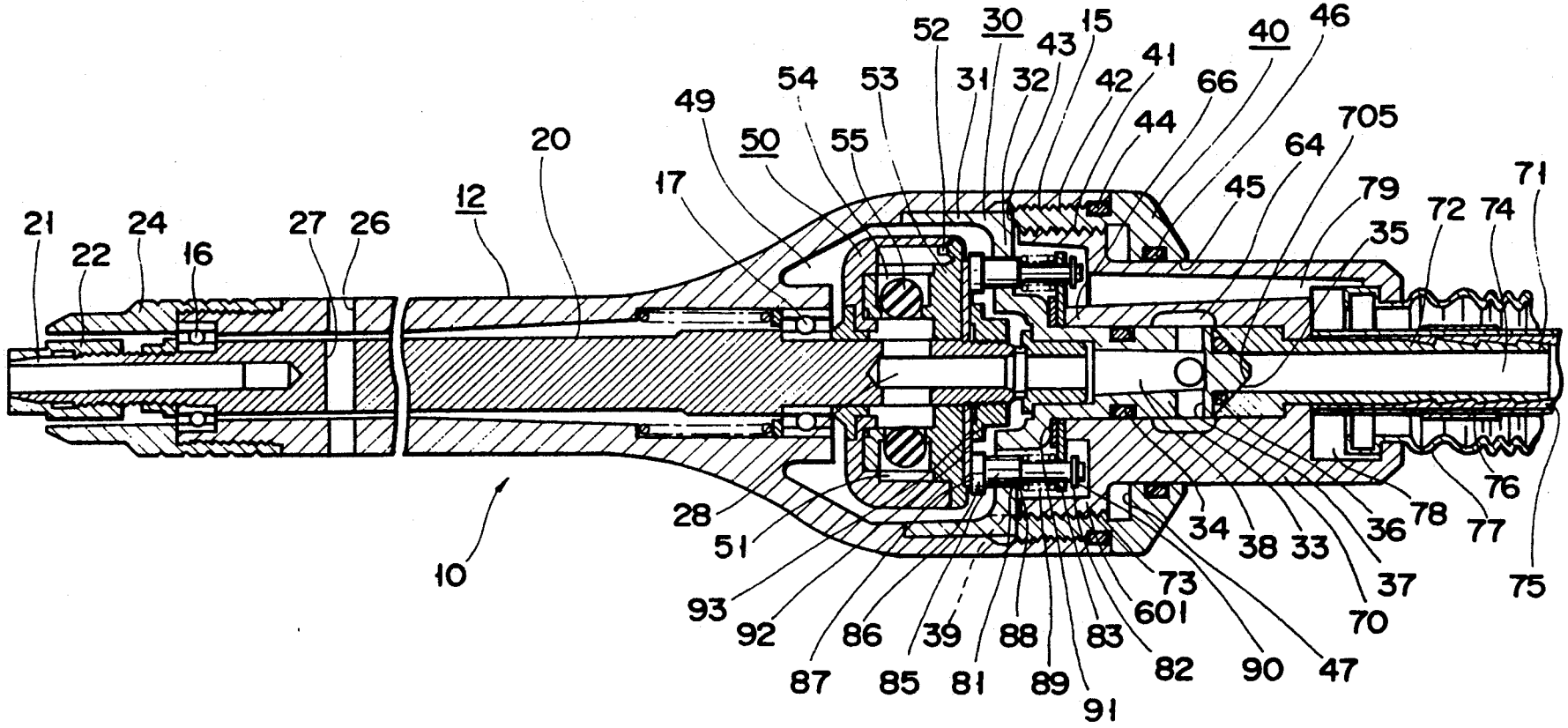
FIG. 1 is a longitudinal sectional view in which a valve is closed.

In the following description, the side where a grinding or cutting tool is connected to the pneumatic rotational tool is referred to as the front portion, front surface, or front end, and the side for supplying compressed air is referred to as the rear portion, rear surface, or rear end.

Numeral 12 indicates a cylindrical housing for a pneumatic rotational tool 10. The housing has a housing front portion having a reduced diameter in which a rotary shaft 20 is rotatably supported by bearings 16 and 17. An end portion 21 of the rotary shaft 20 is formed into a chuck and a grinding tool such as an air grinder (not illustrated) is inserted into the chuck 21 and secured to the rotary shaft 20. Numeral 24 indicates a front cap for covering the end of the rotary shaft 20. Numerals 26 and 27 indicate through-holes extended through the housing front portion and rotary shaft 20 in the radius direction for receiving a pin to prevent rotation of the rotary shaft 20 when fastening the nut 22.

The rear portion of the housing 12 has a large-diameter portion, and an internal thread 15 is formed on the inner surface of the rear end portion. A large-diameter front portion 31 of a casing 30 with its rear having a portion diameter smaller than the diameter of the front-portion is fitted to the inner periphery of the rear housing. A cap 40 having an internal thread 41 and an external thread 42 on the inner and outer peripheries at the front portion is screwed to the internal thread 15 of the rear housing. O-ring 44 is disposed between the rear portion of housing 128 and cap 40. A front end 43 of the cap 40 is in contact with the rear of a throttling section 32.

Thus, a rotor chamber 49 is defined by the rear housing and the large-diameter front portion 31 of the casing 30 and a rotor 50 of an air motor is installed in the rotor chamber 49.

The rotor 50 comprises the rotary shaft 20 and a rotor body 53 fitted to the rear portion of the rotary shaft 20. An air chamber 51 to which compressed air is supplied is defined in the rotor body 53 and a jet hole 52 connected with the air chamber 51 is formed at the outer periphery of the rotor body 53.

The rotor 50 is normally equipped with a speed regulator to prevent excessive rotation and maintain a proper rotational speed. The speed regulator comprises a plurality of through-holes 54 radially extended in the rotor body 53 and a plurality of deformable balls 55 each displaceably received in each through-hole 54.

The speed regulator controls the rotational speed of the rotor 50 by controlling the flow rate of the compressed air flowing through the air chamber 51 through deformation of the balls 55 which move in the radial directions depending on the centrifugal force.

The following is the description of the structure of the rotor body 53 according to FIGS. 3 through 7. The rotor body 53 shown in FIG. 3 comprises the following two members: a concave front portion 56 and a convex rear portion 57 in. When the both portions 56 and 57 are fitted each other, the air chamber 51 is annually formed as shown in FIG. 1.

Figure 3:
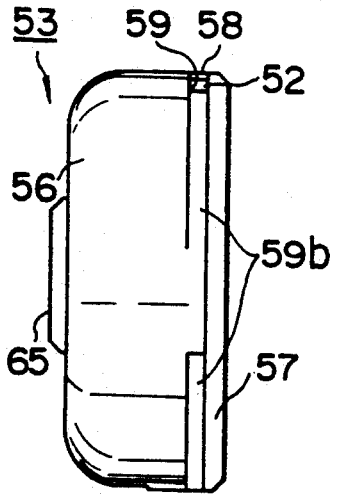
FIG. 3 is a side view of a rotor of an air motor in FIGS. 1 and 2 employed in the embodiment of the present invention.
Figure 4:
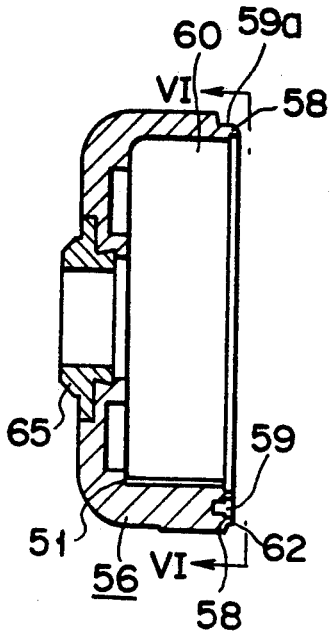
FIG. 4 is a sectional view of the front portion of the rotor in FIG. 3.
Figure 6:
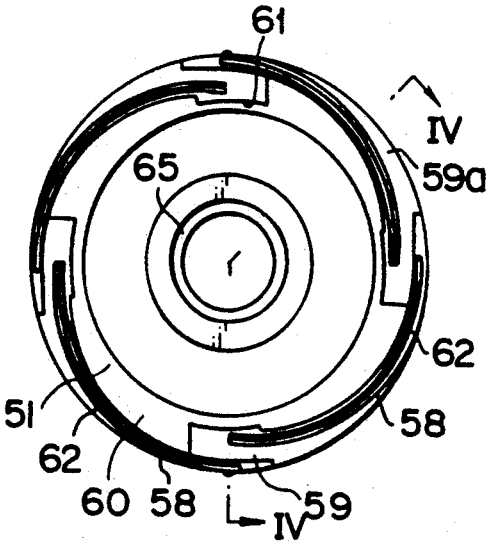
FIG. 6 is a drawing taken along the line VI—VI in FIG. 4.

At the circular rear end of the front portion 56, as shown in FIG. 6, four curved ridges 58 extending from the inner periphery to the outer periphery at the circular rear end are point symmetrically formed, the start and end points of adjacent ridges 58 are slightly overlapped, and a groove 59 is formed between the points. The groove 59 is formed into the jet hole 52 when the front portion 56 and the rear portion 57 are fitted to each other as shown in FIG. 3. As shown in FIG. 6, a space 59*a* is arranged on the outer periphery of the ridge 58 to follow the groove 59 and is formed into a circumferential groove 59*b* when the both portions 56 and 57 are fitted to each other, as shown in FIG. 3.

At least two ridges 58 will be sufficient and are symmetrically arranged. It is preferable to extend the ridges 58 as long as possible so that the amount of compressed air (mentioned later) can be more reserved. It is advantageous to set the groove 59 so that it is more-accurately parallel with the tangent of the outer periphery of the rotor because the torque of the rotor 50 increases.

As shown in FIG. 6, an approximately crescent shaped space is arranged between the air chamber 51 and the ridge 58 to form an air reservoir 60. That is, the approximately crescent shaped air reservoir 60 is formed inside the ridge 58 and the approximately crescent circumferential groove 59*b* is formed outside the ridge 58 when the portions 56 and 57 are fixed to each other. The joint between the air reservoir 60 and the groove 59 is curved so that compressed air smoothly flows. The number of air reservoirs 60 may not necessarily be equal to the number of grooves 59 or the number of jet holes 52.

Numeral 61 in FIG. 6 is a control wall for restricting the movement of the ball 55 in the radially outward direction, which is installed near the start point of the inner periphery of the ridge 58 so that it faces the radially outside open end of the through-hole 54. Numeral 62 is a narrow ridge protruded backwardly from the front end face of the curved ridge 58 to fit the both portions 56 and 57 each other, and 65 is a bush to fit the front portion 56 to the rotary shaft 20.

Rear portion 57, as previously mentioned is configured to form the air chamber 51 between portions 56 and 57 when the rear portion 57 is fitted into the concave front portion 56. The four through-holes 54 are extended in the rear portion 57, each hole 54 causing the air chamber 51 to communicate with its outer end and an intake channel 28 of the rotary shaft 20 to communicate with its inner end. Each through-hole 54 stores a deformable rubber ball 55 having a certain mass and a diameter slightly smaller than the inside diameter of the through-hole 54 so that the ball can freely move. The ball can use various types of elastic materials instead of rubber.

Figure 5:
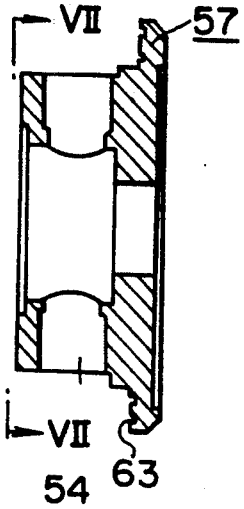
FIG. 5 is a sectional view of the rear portion of the rotor in FIG. 3.
Figure 7:
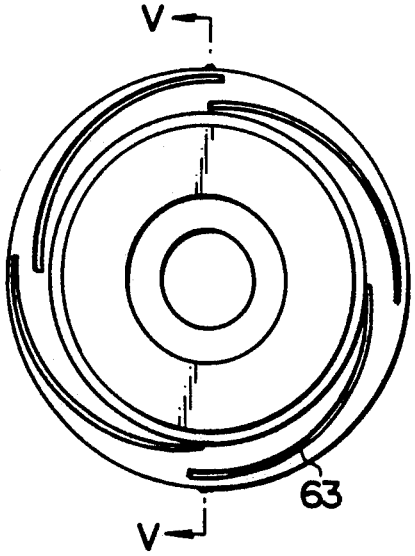
FIG. 7 is a drawing taken along the line VII—VII in FIG. 5.

Numeral 63 in FIGS. 5 and 7 is a groove corresponding to the narrow ridge 62. When the groove 63 and the ridge 62 are fitted to each other, the front portion 56 is integrated with the rear portion 57.

Figure 2:
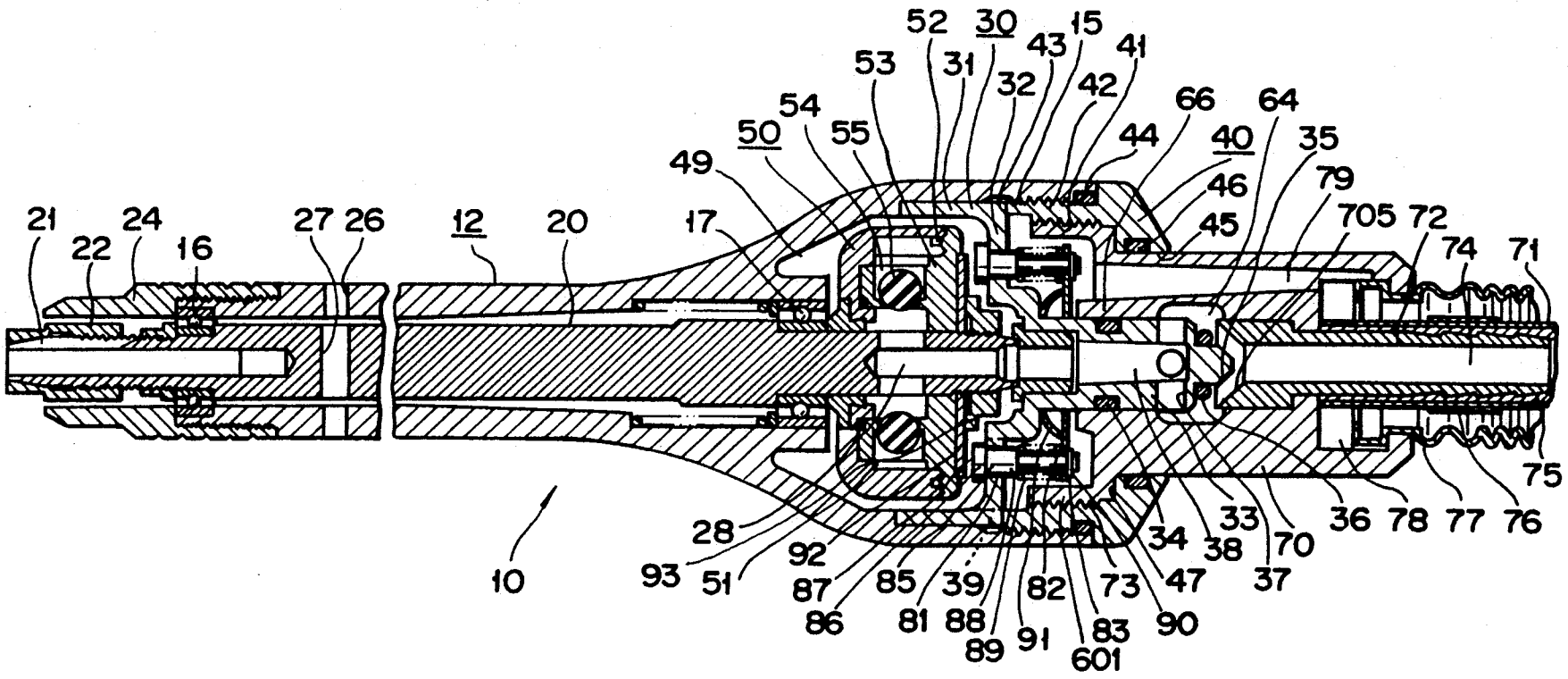
FIG. 2 is a longitudinal sectional view in which the valve is open.

The following is the description of the compressed-air valve system as illustrated in FIGS. 1 and 2.

A valve outside sleeve 70 is slidably fitted to the outer periphery of the small-diameter rear portion 33 of the casing 30 and a valve inside sleeve 72 with a compressed-air supply port 71 extended therethrough is fitted into the rear portion of the valve outside sleeve 70.

The valve outside sleeve 70 can be moved in the axial direction (horizontal direction in FIG. 1) by turning an external thread 73 formed on the outer periphery of the front portion of the valve outside sleeve 70 against the cap 40. When the valve outside sleeve 70 in FIG. 2 is maximally withdrawn, an O-ring 36 fitted to the circumferential groove formed on a tapered surface 35 at the rear end of a small-diameter rear portion 3 of the casing 30 is separated from a valve seat 705 formed at the front end of the valve inside sleeve 72 as a reverse tapered surface to open a fluid channel 74 in the valve inside cylinder 72.

An air hose 75 for supplying air is connected to the air supply port 71 of the valve inside sleeve 72 by securing it with a hose band 76 and an exhaust hose 77 is connected to the rear open end of the valve outside sleeve 70 by surrounding the air hose 75. The air expanded in the rotor chamber 49 flows into the exhaust hose 77 through an exhaust hole 79 formed in the valve outside sleeve 70 in parallel with the axis of the cylinder from an exhaust hole formed in the throttling section 32 of the casing 30.

Numeral 81 is a brake rod linking with valve operation and 92 is a brake disk secured to the rear surface of the rear portion 57. The brake means of the rotor 50 is comprised of the above two parts.

The functions of this air motor are described below.

When the air valve in FIG. 2 is open, compressed drive air is led to the rotor body 53 from the intake channel 28 in the rotary shaft 20, reaches the air chamber 51 through each through-hole 54, flows through the air reservoir 60, and is jetted into the rotor chamber 49 from the jet hole 52. When the compressed air jets, torque is generated by its reaction in the rotor body 53 to rotate the rotor 50.

Because the compressed air jetted from the jet hole 52 does not immediately jet and disperse but it flows along the circumferential groove 59*b* formed in the end of the jet hole 52 in FIG. 2, it increases the torque of the rotor body 53.

The compressed air jetted into the rotor chamber 49 is exhausted from the exhaust hose 77 through the exhaust holes 39 and 79.

When a large centrifugal force works on the ball 55 stored in the through-hole 54 thanks to rotation of the rotor body 53, the ball 55 is energized in the radially outward direction. Therefore, when no load or only a small load is applied to the rotational tool 10, the ball 55 contacts the control wall 61 and deforms due to the reaction in the direction orthogonal to the centrifugal direction to narrow the compressed-air channel and decrease the flow rate of the compressed air.

Meanwhile, when the load of the rotational tool 10 increases, the speed of the rotor body 53 instantaneously decreases but the kinetic energy of the compressed air remaining at the downstream position from the ball 55 contributes to the torque of the rotor body 53. For this embodiment, the instantaneously-decreased speed quickly increases again because a large amount of compressed air stored in the air chamber 51 and air reservoir 60 continuously jets from the jet hole 52.

Thus, because the centrifugal force applied to the ball 55 decreases when the speed of the rotor body 53 decreases, deformation of the ball 55 decreases and the sectional area of the through-hole 54 and supplied amount of compressed air increase, unlike the condition under no load. Consequently, the speed of the rotor body 53 is increased.

Therefore, because the speed and torque of the rotor body 53 change according to the load of the rotational tool 10, a high output can be stably obtained without sudden decrease of the output even if the load suddenly increases.

A brake device according to the present invention will be described.

A plurality of through-holes 81 are formed in the throttling section 32 at equal intervals around an axis thereof to be parallel thereto. A retainer 82 is loosely fitted on the small-diameter rear portion 33 of the casing 30, and a retracted position of the retainer 82 is regulated by a front end 66 of the valve outside sleeve 70. Through-holes 83 the same in number as the through-holes 81 which are smaller than the through-holes 81 are formed in the retainer 82 to be concentric with the through-holes 81.

Numerals 85 are brake rods each having a front portion having a diameter slightly smaller than that of each through-hole 81 formed in the throttling section 32 and a rear portion having a diameter slightly smaller than that of each through-hole 83. A front end 86 of each brake rod 85 has a diameter larger than that of each through-hole 81, and a front surface 87 thereof forms a flat surface. The front portions of the brake rods 85 are loosely inserted in the through-holes 81 in the throttling section 32 of the casing 30, and the rear portions thereof are loosely inserted in the through-holes 83 of the retainer 82. Stepped portions 88 of the brake rods 85 and the front surface of the retainer 82 are biased against each other through compression coil springs 89. Numeral 90 is a stop ring to prevent the brake rods 85 from slipping off, and Numeral 91 is a doughnut-like Belleville spring. The diameter of the brake disc 92 is smaller than that of the rotor body 53. The rotary shaft 20 extends through the central portion of the brake disk 92, and the disk brake 92 is fixed on the rear surface of the rotor body 53 by screwing a nut 93.

The operation of this embodiment will be described.

Assume that the valve is closed as shown in FIG. 1. When the valve outside sleeve 70 is rotated in the housing rear portion to be moved backward, the valve inside sleeve 72 integral with the valve outside sleeve 70 is also moved backward, and a valve seat 705 is separated from the O-ring 36 on a rear end 35 of the casing 30 to open the fluid channel 74 in the valve inside sleeve 72.

At this time, since the front end 66 of the valve outside sleeve 70 is moved backward to no longer urge the retainer 82 from the rear side, the retainer 82 is biased by the compression coil springs 89 and the Belleville spring 91 and is moved backward until it is abutted against the stop ring 90.

Compressed air for driving is supplied from the fluid channel 74 of the valve inside sleeve 72 to the rotor 50 through a circular groove 64, a through-hole 37, the fluid channel 38, and the intake channel 28 in the valve inside sleeve 72. The compressed air is then discharged from the jet nozzle 52 to the rotor chamber 49 through the air chamber 51 to rotate the rotor body 53 and the rotary shaft 20 by its reaction. This torque is transmitted to the grinder of the rotational tool connected to the brake device through the rotary shaft 20.

Air discharged to the rotor chamber 49 is exhausted through the exhaust hole 39 formed in the throttling section 32 of the casing 30 with its exhaust pressure. Then, the retainer 82 is moved backward together with the brake rods 85, the front surfaces 87 of the brake rods 85 are separated from the brake disk 92, and finally the front ends 86 of the brake rods 85 are abutted against the front surface of the throttling section 32 and stopped.

In order to stop driving of the rotational tool, when the valve is kept open as in FIG. 2, the valve outside sleeve 70 is rotated in the direction opposite to that of the above operation. Then, the valve inside sleeve 72 is moved forward, and the valve seat 705 is brought into tight contact with the O-ring at the rear end 35 of the casing 30 to close the fluid channel 74 in the valve inside sleeve 72, thus stopping supply of the compressed driving air.

Simultaneously, the front end 66 of the valve outside sleeve 70 is moved forward while contacting the rear surface of the retainer 82, so that the brake rods 85 biased by the compression coil springs 89 are also moved forward. When the front surfaces 87 of the brake rods 85 at the forward position abut against the brake disk 92, a braking operation is effected to stop rotation of the rotor 50 immediately. The urging force applied on the brake disk 92 is the compression force of the compression coil springs 89, and the brake disk 92 is not influenced by the speed or power to manually rotate the valve outside sleeve 70 when supply of the compressed air is to be stopped.

In the brake device of the pneumatic rotational tool according to the present invention, since the brake device is interlocked with the closing operation of the valve, rotation of the air motor is immediately stopped. Accordingly, safety of the rotational tool is high and the workability is good. Since the brake rods of the brake device are interlocked with the opening/closing operation of the valve, a braking operation and an opening/closing operation of the valve need not be performed separately, leading to a good workability.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A brake device of a pneumatic drive rotational tool, comprising:

a cylindrical housing having two ends and a rotor chamber therein;

a rotary shaft, having an end for mounting a rotational tool which is exposed from one end of said housing, and rotatably provided in said housing;

an air motor, received in said cylindrical housing and having a rotor located in said rotor chamber, for rotating said rotary shaft;

an outside valve sleeve coupled to the other end of said housing and selectively movable, in response to manual rotation thereof, in a direction toward said rotor chamber and in an opposite direction away from said rotor chamber;

an inside valve sleeve, having a compressed air supply channel for guiding compressed air to said rotor chamber to rotate said rotor, and carried in said outside valve for movement therewith toward and away from said rotor chamber;

means for closing said compressed air supply channel when said inside valve sleeve is moved in one direction;

rotor braking means, provided in said housing, for selectively braking said air motor; and means interlocked with the movement of said inside valve sleeve, for braking said air motor by said rotor braking means when said compressed air supply channel is closed.

2. A device according to claim 1, wherein said rotor braking means includes brake rods adjacent said rotor and extending parallel with said rotary shaft.

3. A device according to claim 2, wherein said rotor includes a surface opposing said brake rods, and a brake disk mounted on the surface of the rotor.

4. A device according to claim 2, including a casing fixed to the housing having first through-holes formed therein;

a retainer having second through-holes formed therein;

compression coil springs for biasing the retainer and brake rods in opposite directions;

a Belleville spring for biasing the retainer and casing in the opposite directions; and wherein said brake rods have ends loosely fitted in the first through-holes and opposite ends loosely fitted in the second through-holes.

5. A device according to claim 4, wherein said rotor has a surface opposing said brake rods and includes a brake disk mounted on the surface of the rotor, and each of said compression coil springs is wound around said brake rod and applies a compression brake force to the brake disk.

* * * * *